US007975486B2

(12) United States Patent
Eroglu et al.

(10) Patent No.: US 7,975,486 B2
(45) Date of Patent: Jul. 12, 2011

(54) BURNER FOR PREMIX-TYPE COMBUSTION

(75) Inventors: Adnan Eroglu, Untersiggenthal (CH); Majed Toqan, Adliswil (CH)

(73) Assignee: Alstom Technology Ltd, Baden (CH)

( * ) Notice: Subject to any disclaimer, the term of this patent is extended or adjusted under 35 U.S.C. 154(b) by 987 days.

(21) Appl. No.: 11/452,900

(22) Filed: Jun. 15, 2006

(65) Prior Publication Data

US 2007/0026353 A1 Feb. 1, 2007

(30) Foreign Application Priority Data

Jun. 17, 2005 (CH) ..... 1031/05

(51) Int. Cl.
*F02C 1/00* (2006.01)

(52) U.S. Cl. ..... 60/737; 60/776; 431/351

(58) Field of Classification Search ..... 60/737, 60/738, 748, 776; 431/351, 354
See application file for complete search history.

(56) References Cited

U.S. PATENT DOCUMENTS

| | | | | |
|---|---|---|---|---|
| 4,932,861 | A | 6/1990 | Keller et al. | |
| 5,169,302 | A * | 12/1992 | Keller | 431/351 |
| 5,244,380 | A * | 9/1993 | Dobbeling et al. | 431/354 |
| 5,489,203 | A | 2/1996 | Döbbeling et al. | |
| 5,588,824 | A | 12/1996 | McMillan | |
| 6,102,692 | A * | 8/2000 | Dobbeling et al. | 431/350 |
| 6,176,087 | B1 * | 1/2001 | Snyder et al. | 60/737 |
| 6,263,676 | B1 | 7/2001 | Keller | |
| 7,003,960 | B2 | 2/2006 | Eroglu | |
| 2004/0029058 | A1 | 2/2004 | Eroglu | |

FOREIGN PATENT DOCUMENTS

| | | | |
|---|---|---|---|
| DE | 100 49 205 | A1 | 5/2002 |
| EP | 0 321 809 | A1 | 6/1989 |
| EP | 0 981 016 | A1 | 2/2000 |
| WO | 01/96785 | A1 | 12/2001 |

OTHER PUBLICATIONS

Swiss Search Report dated Aug. 23, 2005 (with English translation of category of cited documents).

* cited by examiner

*Primary Examiner* — Michael Cuff
*Assistant Examiner* — Vikansha S Dwivedi
(74) *Attorney, Agent, or Firm* — Buchanan Ingersoll & Rooney PC

(57) ABSTRACT

The invention relates to a burner for premix-type combustion having a cavity which has at least one tangential air inlet slot for the supply of a combustion air flow, a device for the injection of fuel into the cavity which is provided in the region of a burner axis, and a device for the injection of premix fuel into the air inlet slots which is provided centrally in the inflow region of the combustion air flow. The device for the injection of premix fuel into the air inlet slots has at least one fuel supply, the fuel outlet openings of which are arranged in such a way that the premix fuel is introduced into the combustion air flow on both sides of the at least one fuel supply related to a cross-sectional plane at right angles to the burner axis.

28 Claims, 5 Drawing Sheets

Prior art

BURNER FOR PREMIX-TYPE COMBUSTION

This application is based on and claims priority to Swiss Application No. 01031/05, filed on Jun. 17, 2005 designating the U.S., the entire content of which is hereby incorporated by reference.

TECHNICAL FIELD

The invention relates to a burner for premix-type combustion according to claim 1 and a method for operating a burner according to claim 23.

PRIOR ART

In view of increasingly strict regulations on the emission of harmful substances, great efforts are being made to produce burners with low emission of harmful substances, in particular nitrogen oxides. In this connection, a preferred arrangement is burners in the form of conical hollow bodies which have tangential air inlet slots. Combustion air flows through the air inlet slots into the conical burner cavity. Fuel, in particular gaseous fuel, is supplied to the combustion air flow via fuel outlet openings at the edges of the air inlet slots. Moreover, liquid fuel is introduced, in particular sprayed, into the conical burner cavity at the cone tip. Combustion takes place at the exit of the conical burner cavity.

EP 0 321 809 A1 describes a method for the premix-type combustion of liquid fuel in which a conical liquid fuel column is formed inside the cone cavity and is surrounded by a rotating combustion air flow flowing tangentially into the burner. Ignition of the mixture takes place at the exit of the burner, flame stabilization being brought about in the region of the burner mouth by virtue of the formation of a backflow zone. A corresponding burner which comprises two part cone bodies offset in relation to one another for forming a conical burner cavity, a fuel injection provided centrally between the longitudinal axes of symmetry offset in relation to one another, and tangential air inlet slots is likewise described. The fuel outlet openings for the introduction of the premix fuel are provided at the edges of the air inlet slots. In order to achieve sufficient mixing of the premix fuel with the combustion air over the entire width of the air inlet slot, a high pressure is necessary for the injection of the premix fuel into the combustion air flow flowing in at high speed. As the injection takes place from one side of the air inlet slot and homogeneous mixing of the premix fuel with the combustion air over the entire width of the air inlet slot is thus not achieved, optimum nitrogen emission values are not obtained.

EP 0 981 016 B1 describes a burner which likewise has the conical construction described above with tangential air inlet slots for the introduction of a combustion air flow. This burner also has an injection device for the injection of fuel into the combustion air flow. This injection device is arranged centrally in the combustion air flow in front of the air inlet slots in order to inject the fuel in a flow direction parallel to the combustion air flow.

WO 01/96785 A1 describes a burner and a corresponding method for operating a burner, where two or more fuel supplies with fuel outlet openings arranged essentially in the direction of the burner axis are provided, which can introduce premix fuel into the burner space separately from one another. This makes it possible to achieve stepped injection of fuel into the burner space which is adapted to the changing conditions during operation of the burner as a result of different loads, gas qualities or gas preheating temperatures, for example.

DE 100 49 205 A1 describes a method and a device for supplying fuel to a premix burner, where the premix fuel supply is effected via at least two spatially axially separated regions along the burner, so that, for starting the turbine and for continued running-up of the load to full load, a stepwise or continuous redistribution of the supply of the premix fuel between the regions takes place.

SUMMARY OF THE INVENTION

It is an object of the present invention to propose a burner for premix-type combustion and a method for operating a burner which make possible stable premix-type combustion with as homogeneous as possible a mixing of the premix fuel with the combustion air and with reduced harmful substance emission.

This object is achieved by a burner for premix-type combustion with the features of claim 1 and a method for operating a burner with the features of claim 23. Preferred developments of the invention emerge from the dependent claims.

A major concept of the invention is that the means provided centrally in the inflow region of the combustion air flow for the injection of premix fuel into the tangential air inlet slots of a burner cavity are designed in such a way that, related to a cross-sectional plane at right angles to the burner axis, they inject the premix fuel into the combustion air flow not only centrally but also in more than one place in order to achieve as homogeneous as possible a mixing of the premix fuel with the combustion air. A high emission of harmful substances, in particular nitrogen oxides, as a result of inadequate premixing is consequently avoided.

In concrete terms, the invention relates to a burner for premix-type combustion which comprises a cavity which has at least one tangential air inlet slot for the supply of a combustion air flow, means for the injection of fuel into the cavity which are provided in the region of a burner axis, and means for the injection of premix fuel into the at least one air inlet slot which are provided centrally in the inflow region of the combustion air flow. The means for the injection of premix fuel into the at least one air inlet slot have at least one fuel supply, the fuel outlet openings of which are arranged in such a way that the premix fuel is introduced into the combustion air flow on both sides of the at least one fuel supply related to a cross-sectional plane at right angles to the burner axis. Relatively homogeneous mixing of the premix fuel with the combustion air over the entire width of the air inlet slot and therefore improved nitrogen emission values can thus be achieved. Moreover, the pressure for the injection of the premix fuel into the combustion air flow flowing in at relatively high speed can be reduced in comparison with unilateral injection from the edge of the air inlet slot.

The burner is preferably designed in such a way that the cavity is formed by at least two part cone bodies which complement one another to form a body, which form a cone cavity and the longitudinal axes of symmetry of which are offset radially in relation to one another and enclose at least two tangential air inlet slots for the supply of a combustion air flow. Alternatively, the burner can be designed in such a way that the cavity is formed by at least two part cylinder bodies which complement one another to form a body, which form a cylinder cavity and the longitudinal axes of symmetry of which are offset radially in relation to one another and enclose at least two tangential air inlet slots for the supply of a combustion air flow. Tulip-shaped or cup-shaped designs of the cavity are likewise possible.

In addition, the burner can have a mixing section arranged downstream of the cavity for transferring a flow of a fuel mixture generated in the cavity into a combustion chamber. This can increase the stability of the flameless combustion.

In particular, the fuel outlet openings have a common fuel supply provided along the respective tangential air inlet slot. The number of fuel supplies can inter alia be dependent on the number of air inlet slots, which in turn for example is dependent on whether the cavity is formed by two or more part bodies.

In a preferred embodiment, the fuel outlet openings are designed as a pair of slit nozzles extending longitudinally over the entire length of the fuel supply. Premix fuel can thus be supplied to the combustion air flow in a uniformly distributed manner over the entire length of the tangential air inlet slot.

On the other hand, the fuel outlet openings can have circular or oval cross sections. By virtue of different opening diameters or passage cross sections, a different penetration depth of the premix fuel into the combustion air flow can be achieved in order thus for it to be possible to realize different mixture distributions. In order to achieve as uniform as possible a distribution of the premix fuel over the entire length of the tangential air inlet slot, the fuel outlet openings can be distributed in pairs uniformly over the entire length of the tangential air inlet slot. The arrangement, distribution and design of the fuel outlet openings influences the fuel distribution inside the burner and thus its combustion quality.

In order to make it possible to step the introduction of premix fuel into the combustion air flow and thus to optimize adaptation of the burner behavior during starting of the connected gas turbine, for example, or during operation in different load ranges, the fuel outlet openings can be arranged in a grouped manner in such a way that a first group of fuel outlet openings is distributed uniformly over the entire length of the tangential air inlet slot and has a first common fuel supply and that a second group of fuel outlet openings is distributed along a part region of the overall length of the tangential air inlet slot and has at least one second common fuel supply.

In another embodiment for stepped introduction of premix fuel, the fuel outlet openings are arranged in a grouped manner in such a way that a first group of fuel outlet openings is distributed uniformly over a first part region of the overall length of the tangential air inlet slot and has a first common fuel supply and that at least one second group is distributed along a further part region of the overall length of the tangential air inlet slot and has at least one second common fuel supply. A stepped supply of premix fuel can be advantageous during starting of the gas turbine, when the entire premix fuel supply is preferably to take place via the first, upstream group of fuel outlet openings. During continued running-up of the gas turbine to full load, the premix fuel supply can be shifted stepwise or continuously to the second, downstream group of fuel outlet openings.

In a preferred embodiment of the burner, the part regions do not overlap. Depending on operating mode of the burner, however, it may also be desirable that at least two part regions overlap.

In order to influence the degree of mixing of combustion air and premix fuel over the entire length of the tangential air inlet slot, the fuel outlet openings of two or more groups can have different cross sections. The group of fuel outlet openings which is to inject smaller premix fuel quantities can thus have smaller injection cross sections and vice versa.

In order to reduce the pressure loss during inflow of the combustion air, the fuel supplies can have a streamlined profile related to a cross sectional plane at right angles to the burner axis.

Furthermore, the fuel supplies can be provided in front of the air inlet slots related to the direction of the combustion air flow. They can thus be arranged in a region where the speed of the combustion air flow is lower than directly in the air inlet slots. Aerodynamic losses and the pressure necessary for the injection of the premix fuel can thus be reduced.

In order to adapt the premix fuel supply to the operating mode of the burner, or the load conditions of a gas turbine for example, the fuel supplies can have means for regulating the mass flow of the premix fuel.

It is advantageous in particular in the case of an embodiment with stepped premix fuel supply if the fuel supplies to the groups of fuel outlet openings have means for regulating the mass flow of the premix fuel in order to admit fuel to them independently of one another or to influence the penetration depth of the premix fuel into the combustion air flow and thus the mixing quality. It may even be possible to dispense with the additional supply of pilot fuel for starting the gas turbine or in low-load operation in the region of the central fuel injection on the burner axis.

The means for the injection of premix fuel into the air inlet slots are preferably embodied as a standard component. When another fuel is used, merely the component for the premix fuel supply can thus be exchanged, and it is then no longer necessary to exchange the entire burner. It is moreover possible to retrofit other burners with such a device. For this, the standard component can have means for fastening to a burner. Such a construction can not only increase flexibility in the use of said burners but can also simplify the production of the cast part cone bodies as the integration of the fuel supplies and the fuel outlet openings into the cast part cone bodies is no longer necessary.

In a further preferred embodiment of the burner, the means for the injection of fuel into the cavity which are provided in the region of the burner axis are embodied as a jet pipe which, in addition to a central outlet nozzle for liquid fuel, has fuel outlet openings for the supply of premix fuel in a part region of the jet pipe along the burner axis remote from the end on the combustion-space side with an associated fuel supply. In particular applications with jet pipes which project further into the cavity have proved to be advantageous with regard to combustion stability as they can for example prevent undesirable influence between pilot fuel and premix fuel. It is moreover possible to dispense with a device for extinguishing the burner when switching off, for example.

Alternatively, the means for the injection of fuel into the cavity which are provided in the region of the burner axis can be embodied as a conical body, the cone tip of which is aligned downstream and has an outlet nozzle for fuel.

For additional stabilization and for reducing humming noises, the burner can be arranged together with a secondary burner as a hybrid burner.

The invention also relates to a method for operating a burner which comprises a cavity which has at least one tangential air inlet slot for the supply of a combustion air flow, means for the injection of fuel into the cavity which are provided in the region of a burner axis, and means for the injection of premix fuel into the air inlet slots which are provided centrally in the inflow region of the combustion air flow. The means for the injection of premix fuel into the air inlet slots introduce the premix fuel into the combustion air flow on both sides of fuel supplies related to a cross-sectional plane at right angles to the burner axis. The penetration depth and the mixing-in of the premix fuel jet can influence the mixing quality of the premix fuel and the combustion air and thus the fuel distribution at the burner mouth. These can in turn be decisive for the combustion stability and the level of harmful substance emissions, in particular nitrogen emissions.

In particular, with such a method, gaseous fuels can be introduced into the combustion air flow on both sides of the fuel supplies related to a cross-sectional plane at right angles to the burner axis.

In order to achieve as stable a combustion as possible in the region of the burner mouth, the premix fuel can be introduced uniformly over the entire length of the tangential air inlet slot. Good mixing of the fuels is the prerequisite in such premix burners for low nitrogen oxide emission values during the combustion process.

In order on the other hand to meet the different demands on the burner during starting of a gas turbine or during operation at full load, for example, the premix fuel can be introduced separately via at least two part regions of the overall length of the tangential air inlet slot. The burner can be operated stably with low nitrogen emission values even with a change in load or fuel quality by controlling the premix fuel supply of a first part region in relation to at least one second part region.

In order to reduce aerodynamic losses and the pressure necessary for the injection of the premix fuel, the premix fuel can be introduced in front of the air inlet slots related to the direction of the combustion air flow and thus in a region where the speed of the combustion air flow is lower than directly in the air inlet slots.

Furthermore, the supply of the premix fuel to the individual fuel outlet openings can be carried out adjustably. It can be advantageous in particular in the case of stepped introduction of the premix fuel to carry out the supply of the premix fuel to the fuel outlet openings of the part regions load-dependently and independently of one another. Moreover, the premix fuel can also be introduced dependently on measured pressure fluctuations, harmful substance emission values or material temperatures of the burner so as thus to ensure stable combustion.

In order to make injection of premix fuel into the cavity which is directed outward radially from the jet pipe possible, the means for the injection of fuel into the cavity which are provided in the region of the burner axis and embodied as a jet pipe can, in addition to introducing liquid fuel through a central outlet nozzle, introduce premix fuel via a part region of the jet pipe along the burner axis remote from the end on the combustion-space side. In this way, the introduction of the premix fuel into the cavity can be still better stepped and better adaptation of the combustion to different operating conditions can be achieved.

BRIEF DESCRIPTION OF THE DRAWINGS

The invention is explained below with reference to illustrative embodiments in conjunction with the drawings, in which.

MODES OF EMBODYING THE INVENTION

Figure 1:
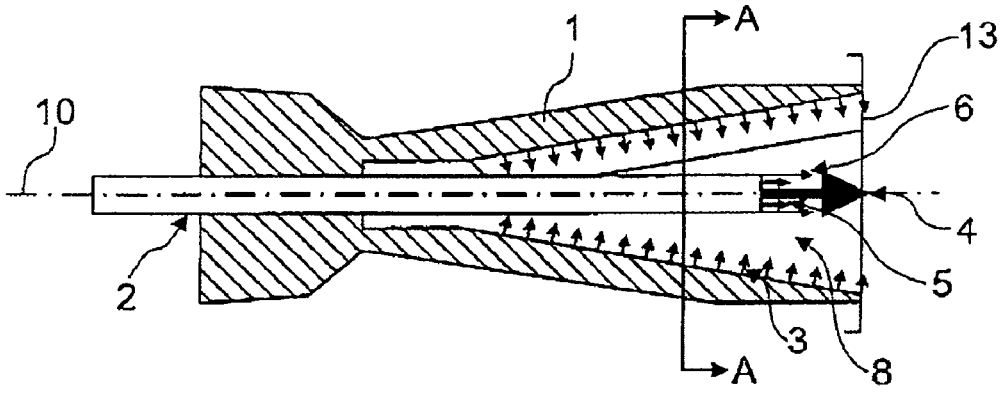
Fig. 1 Prior art
FIG. 1 shows a longitudinal cross section of a conical burner according to the prior art.
Figure 2:
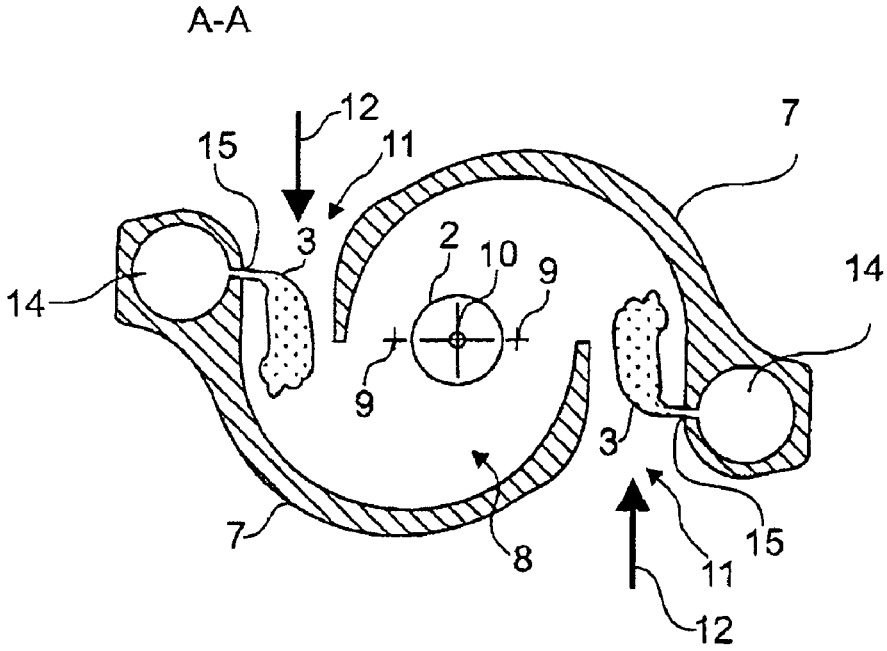
FIG. 2 shows a cross section along the line A-A of the burner illustrated in FIG. 1.

FIG. 1 shows a longitudinal cross section of a conical burner 1 according to the prior art, as described in EP 0 321 809 A1, for example. In this connection, FIG. 2 shows a cross section along the line A-A of the burner illustrated in FIG. 1. Reference is made below to the numbers of both FIG. 1 and FIG. 2.

The cone cavity 8 of the burner 1 is formed by two part cone bodies 7 which are displaced radially in relation to one another. The displacement of the longitudinal axes of symmetry 9 of the part cone bodies 7 forms tangential air inlet slots 11, through which the combustion air 12 mixed with premix fuel 3 flows into the cone cavity 8. The burner axis 10 lies centrally and on a line between the longitudinal axes of symmetry 9 of the part cone bodies 7. A jet pipe 2 is provided in the region of this burner axis 10 in order to inject liquid fuel 4 into the combustion space 8. In addition, pilot fuel 6 is introduced into the cone cavity, for initiating or stabilizing the combustion for example. Air for shielding 5 is introduced between the pilot fuel 6 and the liquid fuel 4 in order to prevent premature mixing of liquid fuel 4 and pilot fuel 6 and thus premature ignition of the fuels.

The liquid fuel 4 injected through the jet pipe 2 forms a conical fuel column which is surrounded by the rotating combustion air 12 mixed with premix fuel 3. The strength of the rotation is dependent on the design of the cone angle and the number and width of the air inlet slots 11. With appropriate selection of these parameters, ignition of the fuel mixture takes place at the exit of the burner 1, flame stabilization being brought about in the region of the burner mouth 13 by virtue of the formation of a backflow zone.

The fuel outlet openings 15 for the introduction of the premix fuel 3 are provided at the edges of the air inlet slots 11. In order to achieve sufficient mixing of the premix fuel 3 with the combustion air 12 over the entire width of the air inlet slot 11, a high pressure is necessary for the injection of the premix fuel 3 into the combustion air flow 12 flowing in at high speed. The injection takes place from one side of the air inlet slot 11. Homogeneous mixing of the premix fuel with the combustion air over the entire width of the air inlet slot is thus not achieved, and optimum nitrogen emission values are therefore not obtained.

The fuel supplies 14, which are integrated in the part cone bodies 7, are subjected to high thermal loads by virtue of the contact with on the one hand cold fuel and on the other hand hot combustion air, which can lead to these components having a relatively short life. As the fuel supplies 14 and the fuel outlet openings 15 are an integral part of the cast part cone bodies 7, it is necessary to exchange the entire burner 1 when another fuel is used. Moreover, the integration of the fuel supplies 14 and the fuel outlet openings 15 into the cast part cone bodies 7 is technically complicated and expensive.

Figure 3:
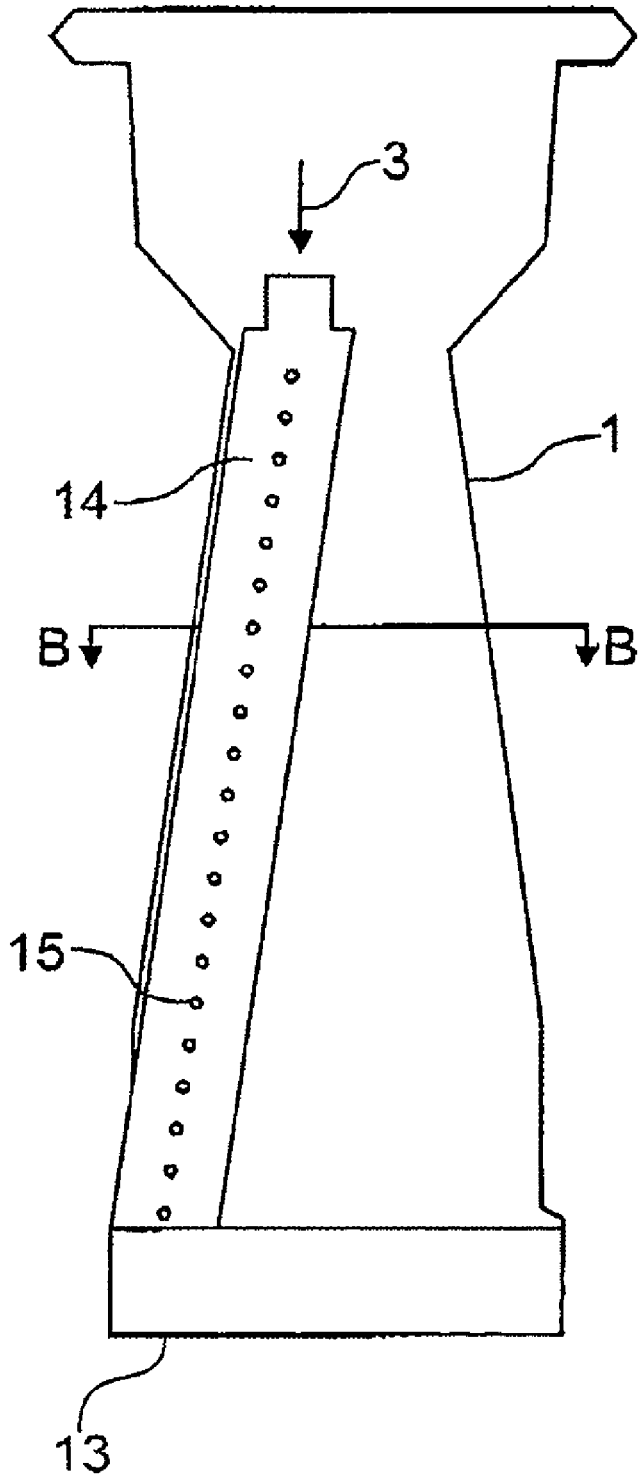
FIG. 3 shows a longitudinal cross section of a conical burner with the means provided centrally in the inflow region of the combustion air flow for the injection of premix fuel into the air inlet slots.
Figure 4:
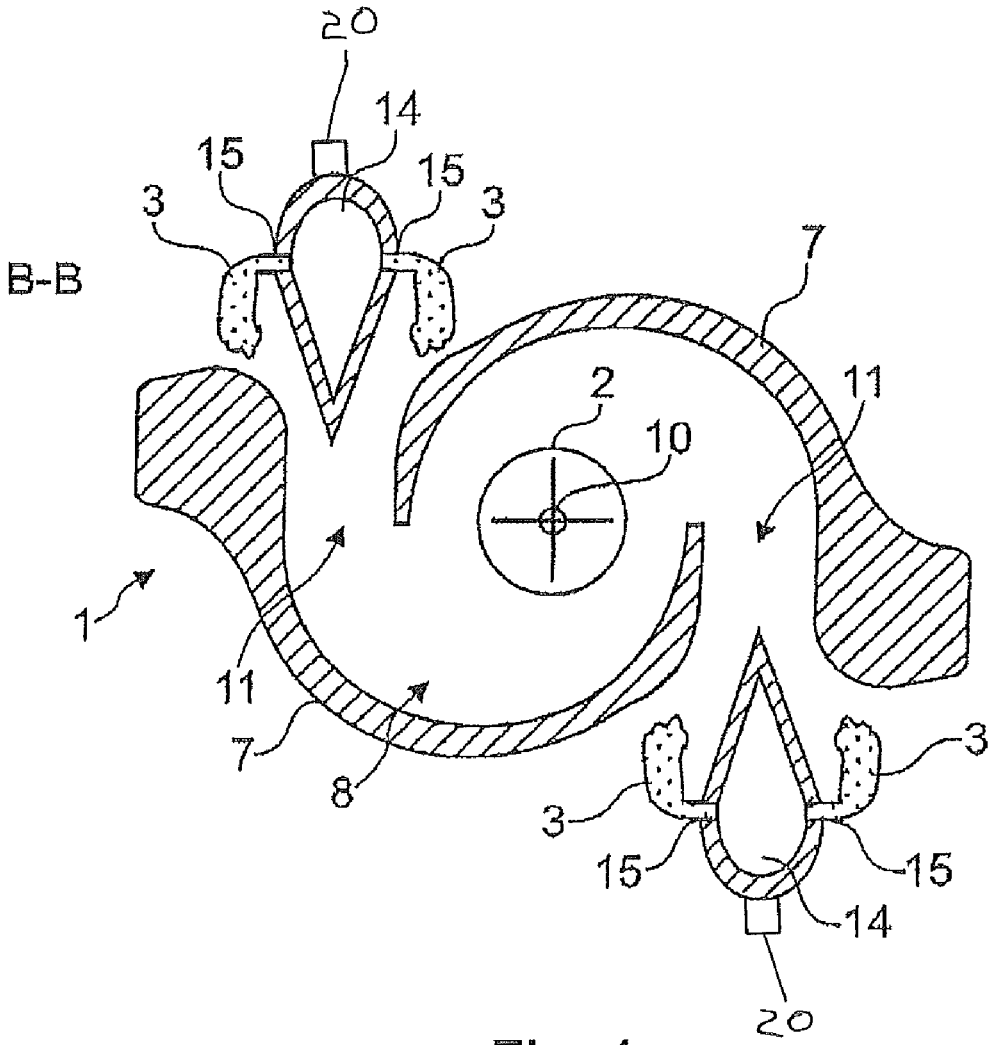
FIG. 4 shows a cross section along the line B-B of the burner illustrated in FIG. 3.

FIG. 3 shows a longitudinal cross section of a conical burner 1 with the means provided centrally in the inflow region of the combustion air flow 12 for the injection of premix fuel 3 into the air inlet slots 11. FIG. 4 shows a corresponding cross section along the line B-B of the burner illustrated in FIG. 3. Reference is made below to the numbers of both FIG. 3 and FIG. 4.

In contrast to the burner illustrated in FIG. 1 and FIG. 2, the burner 1 illustrated in FIG. 3 and FIG. 4 has fuel supplies 14 which are not part of the part cone body 7. They are embodied as an independent component which is arranged centrally in the inflow region of the combustion air flow 12. Furthermore, fuel outlet openings 15 which introduce the premix fuel 3 into the combustion air flow 12 are located on both sides of the fuel supply 14 related to a cross-sectional plane at right angles to the burner axis 10. The fuel outlet openings 15 have a circular cross section. In other embodiments, the fuel outlet openings can have oval or slit-shaped cross sections. The harmful substance emission values, the flame backflow behavior and the flame stability can be influenced by appropriate selection of the arrangement, size and number of the fuel outlet openings 15.

The fuel outlet openings 15 of a tangential air inlet slot 11 are supplied with premix fuel 3 via a common fuel supply 14. The fuel supply 14 can be equipped with means 20 which regulate the mass flow of the fuel in order to adapt it to the instantaneous operating conditions of the burner. The fuel supply 14 is arranged spatially in front of the air inlet slots 11, that is in a region where the speed of the combustion air flow 12 is lower than directly in the air inlet slots. Aerodynamic losses and the pressure necessary for the injection of the premix fuel 3 are thus reduced. Moreover, the fuel supplies 14 have a streamlined profile related to a cross-sectional plane at right angles to the burner axis 10 in order to reduce the pressure loss during inflow of the combustion air 12.

As the premix fuel 3 is introduced into the combustion air flow 12 centrally and on both sides of the fuel supply 14, relatively homogeneous mixing of premix fuel 3 and combustion air 12 is brought about, which leads to combustion in the burner 1 with low nitrogen emissions.

By virtue of the premix fuel supply being embodied as an independent component, the entire burner 1 does not have to be exchanged when another fuel is used, but only the component for the premix fuel supply. It is moreover possible to retrofit other burners with such a device. Furthermore, the technical production of the cast part cone bodies is less complicated as the integration of the fuel supplies 14 and the fuel outlet openings 15 into the cast part cone bodies 7 is no longer necessary. The thermal loading of the burner, or of the part cone bodies, which arises in the burner mentioned in the prior art owing to the different temperatures of on the one hand cold fuel and on the other hand hot combustion air is reduced as there is no longer direct contact with the fuel supply supplying the cold fuel.

Figure 5:
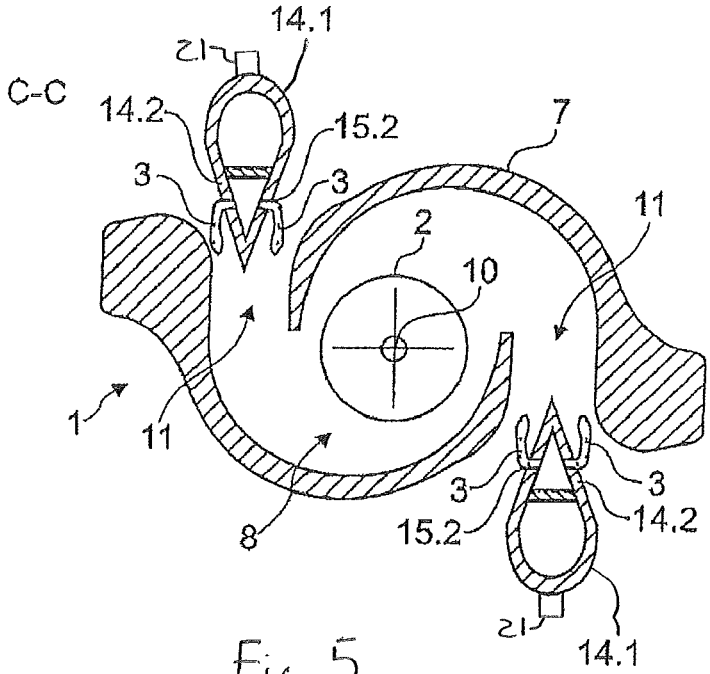
FIG. 5 shows a longitudinal cross section of a conical burner with two groups of fuel outlet openings which are distributed along two part regions of the entire length of the tangential air inlet slot.
Figure 6:
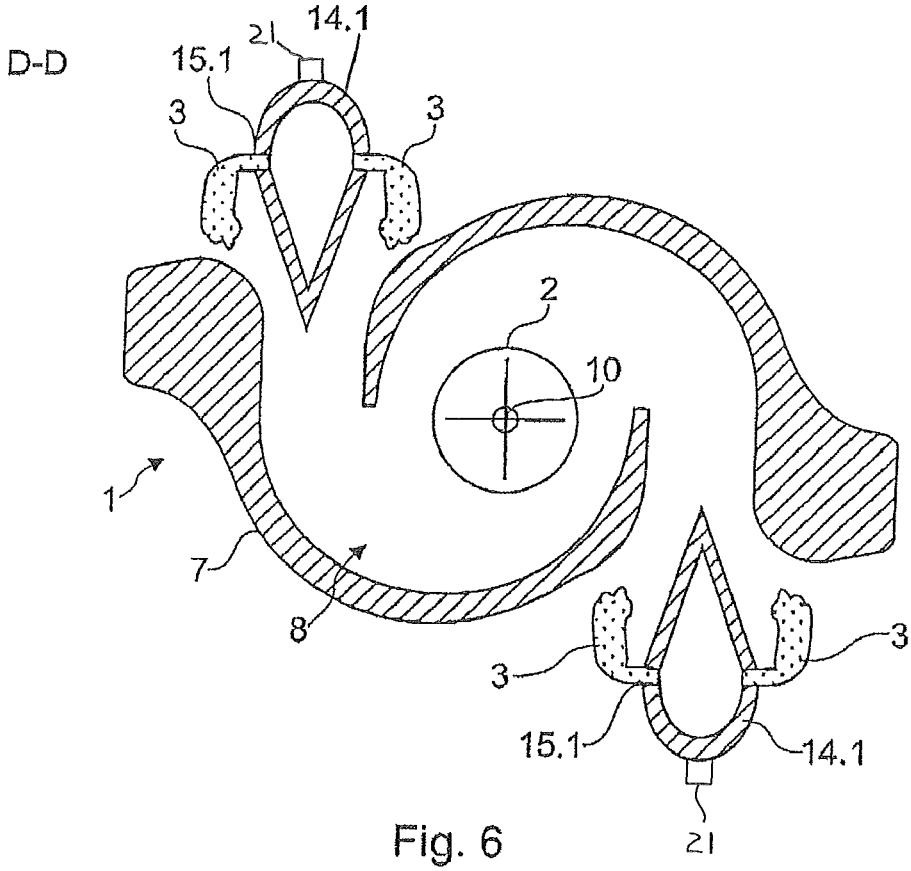
FIG. 6 shows two cross sections along the lines C-C and D-D of the burner illustrated in FIG. 5.

FIG. 5 shows a longitudinal cross section of a conical burner 1 with two groups of fuel outlet openings 15.1, 15.2 which are distributed along two part regions 16, 17 of the overall length of the tangential air inlet slot 11. In this connection, FIG. 6 illustrates two cross sections along the lines C-C and D-D of the burner 1 illustrated in FIG. 5. Reference is made below to the numbers of both FIG. 5 and FIG. 6.

The fuel supply illustrated here of the tangential air inlet slot 11 is divided into two separate fuel supplies 14.1 and 14.2. In the first part region 16 of the overall length of the tangential air inlet slot 11, premix fuel 3 supplied via the fuel supply 14.2 is introduced through the fuel outlet openings 15.2 into the combustion air flow 12. Similarly, in the second part region 17 of the overall length of the air inlet slot 11, premix fuel 3 supplied via the fuel supply 14.1 is introduced via the fuel outlet openings 15.1 into the combustion air flow 12.

Such stepped introduction of premix fuel 3 into the combustion air flow 12 makes it possible to optimize adaptation of the burner behavior during starting of the connected gas turbine, for example, or during operation in different load ranges. A supply of premix fuel 3 in separate part regions along the burner axis 10 is advantageous during starting of the gas turbine, when the entire premix fuel supply is preferably to take place in the upstream part region 16. During continued running-up of the gas turbine to full load, the premix fuel supply can be shifted stepwise or continuously to the downstream part region 17. In this connection, means 21 for regulating the mass flow of the premix fuel in order to admit premix fuel 3 to the fuel supplies 14.1, 14.2 independently of one another and to regulate the mass flow of the premix fuel 3 inside a fuel supply 14.1, 14.2 prove especially advantageous.

In particular, combustion oscillations which occur during the change-over processes of a gas turbine and in turn lead to pressure fluctuations which have a disruptive effect on the operation of the gas turbine are counteracted with stepped introduction of the premix fuel. It may even be possible to dispense with the supply of pilot fuel for starting the gas turbine or in low-load operation as mentioned in the description of FIGS. 1 and 2. It is furthermore conceivable to use dry oil in the operation of a burner according to this invention.

Figure 7:
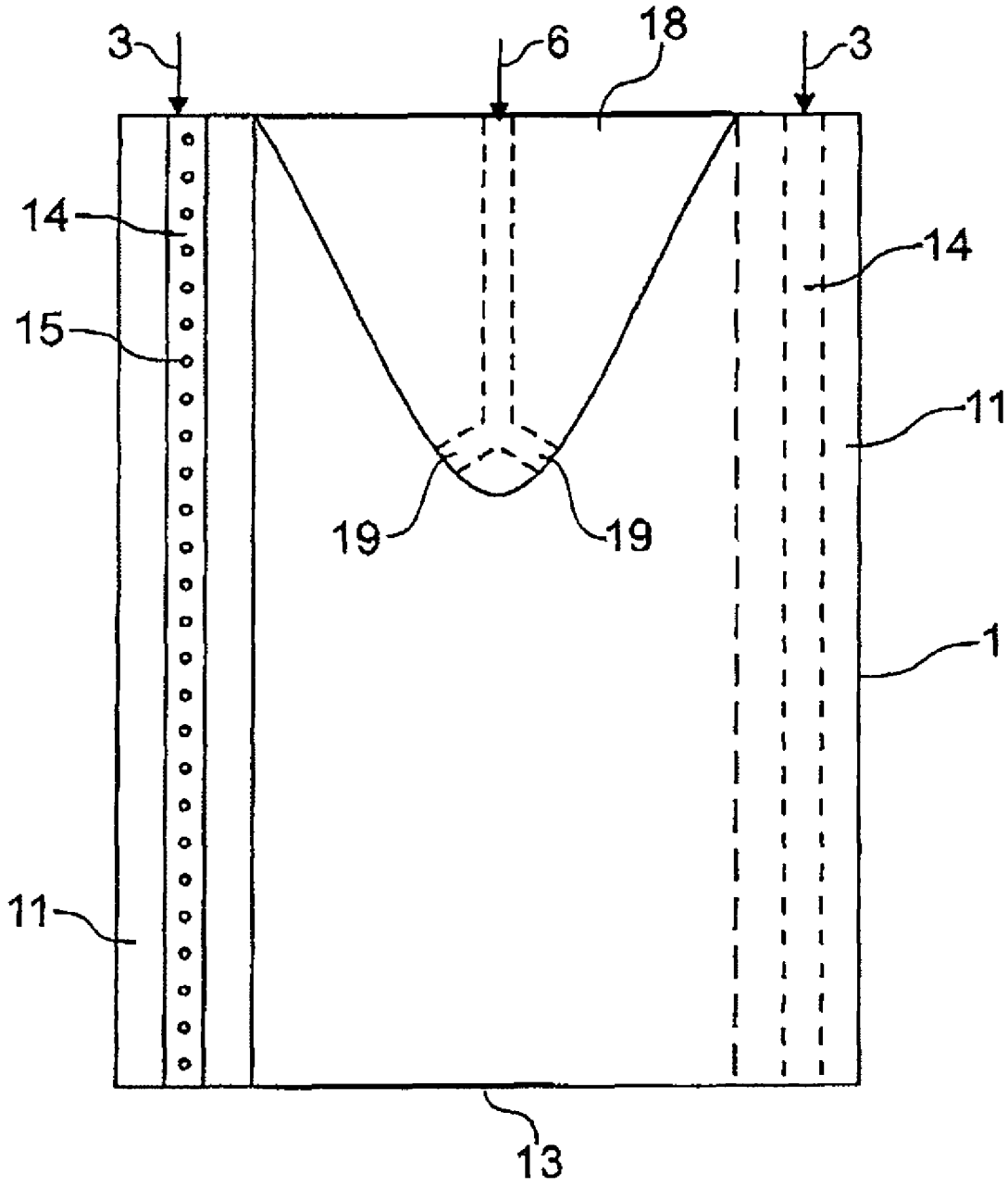
FIG. 7 shows a longitudinal cross section of a cylindrical burner with the means provided centrally in the inflow region of the combustion air flow for the injection of premix fuel into the air inlet slots.

FIG. 7 shows a longitudinal cross section of a cylindrical UTC burner 1 (as United Technologies Corporation burners are known; one of these UTC burners is disclosed in WO 93/17279, for example; WO 93/17279 is hereby regarded as included fully in the description) with a burner mouth 13 and the means provided centrally in the inflow region of the combustion air flow for the injection of premix fuel 3 into the air inlet slots 11. The means 18 for the injection of fuel into the cavity of the burner 1 are embodied as a conical body, the cone tip of which is aligned downstream and has a number of outlet nozzles 19 for the pilot fuel 6 arranged in a ring on the cone tip.

Here as well, the burner 1 illustrated has fuel supplies 14 which are not part of the part cylinder bodies. They are embodied as independent components which are arranged centrally in the inflow region of the combustion air flow, that is in the air inlet slots 11. The fuel supplies 14 have fuel outlet openings 15 which introduce the premix fuel 3 into the combustion air flow. The fuel outlet openings 15 have a circular cross section. Alternatively, the fuel outlet openings can also have oval or slit-shaped cross sections.

The functioning of the illustrated means for the injection of premix fuel in this UTC burner is similar to the functioning of these means in the burner with conically designed cavity illustrated in FIGS. 3 to 6. All the designs of the means for the injection of premix fuel mentioned in the description of FIGS. 3 to 6 can likewise be applied to the UTC burner 1. It is likewise the case that the different designs of the means for the injection of premix fuel can be applied to burners which have a tulip-shaped or cup-shaped cavity. Here as well, the functioning of the means for the injection of premix fuel is similar to the functioning of these means in the burner with conically designed cavity illustrated in FIGS. 3 to 6.

LIST OF REFERENCE NUMBERS

1 burner
2 jet pipe
3 premix fuel

4 liquid fuel
5 air for shielding
6 pilot fuel
7 part cone body
8 cone cavity
9 longitudinal axis of symmetry of the part cone body
10 burner axis
11 air inlet slot
12 combustion air flow
13 burner mouth
14 fuel supply
14.1 first common fuel supply
14.2 second common fuel supply
15 fuel outlet opening
15.1 fuel outlet opening in the first part region
15.2 fuel outlet opening in the second part region
16 first part region of the overall length of the tangential air inlet slot
17 second part region of the overall length of the tangential air inlet slot
18 conical means for the injection of fuel into the cavity
19 outlet nozzle for pilot fuel

The invention claimed is:

1. A burner for premix-type combustion comprising a cavity which has at least one tangential air inlet slot for the supply of a combustion air flow, means for the injection of fuel into the cavity, and means for the injection of premix fuel into the at least one air inlet slot which are provided centrally in the inflow region of the combustion air flow, wherein the means for the injection of premix fuel into the at least one air inlet slot includes at least one fuel supply having a first side and a second side and fuel outlet openings on the first side and fuel outlet openings on the second side, the premix fuel being introduced into the combustion air flow on the first and second sides of the at least one fuel supply in a cross-sectional plane at right angles to a burner axis; and the fuel outlet openings are provided upstream of the air inlet slots relative to a direction of the combustion air flow where a speed of the combustion air flow is less than a speed of a combustion air flow in the air inlet slots.

2. The burner as claimed in claim 1, wherein the cavity is formed by at least two part cone bodies which complement one another to form a body, which form a cone cavity and the longitudinal axes of symmetry of which are offset radially in relation to one another and enclose at least two tangential air inlet slots for the supply of a combustion air flow.

3. The burner as claimed in claim 1, wherein the cavity is formed by at least two part cylinder bodies which complement one another to form a body, which form a cylinder cavity and the longitudinal axes of symmetry of which are offset radially in relation to one another and enclose at least two tangential air inlet slots for the supply of a combustion air flow.

4. The burner as claimed in claim 1, wherein a mixing section for transferring a flow of a fuel mixture generated in the cavity into a combustion chamber is arranged downstream of the cavity.

5. The burner as claimed in claim 1, wherein the fuel outlet openings have a common fuel supply provided along the respective tangential air inlet slot.

6. The burner as claimed in claim 5, wherein the fuel outlet openings are designed as a pair of slit nozzles extending longitudinally over the entire length of the fuel supply.

7. The burner as claimed in claim 1, wherein the fuel outlet openings have circular or oval cross sections.

8. The burner as claimed in claim 1, wherein the fuel outlet openings are distributed in pairs uniformly over the entire length of the tangential air inlet slot.

9. The burner as claimed in claim 1, wherein the fuel outlet openings are arranged in a grouped manner in such a way that a first group of fuel outlet openings is distributed uniformly over the entire length of the tangential air inlet slot and have a first common fuel supply and wherein a second group of fuel outlet openings are distributed along a partial region of the overall length of the tangential air inlet slot and have at least one second common fuel supply.

10. The burner as claimed in claim 9, wherein the fuel outlet openings of two or more groups of fuel outlet openings have different cross sections.

11. The burner as claimed in claim 1, wherein the fuel outlet openings are arranged in a grouped manner in such a way that a first group of fuel outlet openings are distributed uniformly over a first part region of the overall length of the tangential air inlet slot and have a first common fuel supply and wherein at least one second group of fuel outlet openings is distributed along a further part region of the overall length of the tangential air inlet slot and have at least one second common fuel supply.

12. The burner as claimed in claim 11, wherein the part regions do not overlap.

13. The burner as claimed in claim 11, wherein the at least two part regions overlap.

14. The burner as claimed in claim 11, comprising:

a regulator whereby a mass flow of the premix fuel is regulated in order to admit fuel to the groups of fuel outlet openings independently of one another.

15. The burner as claimed in claim 1, wherein the fuel supplies have a streamlined profile related to a cross sectional plane at right angles to the burner axis.

16. The burner as claimed in claim 1, comprising:

a regulator whereby the mass flow of the premix fuel is regulated.

17. The burner as claimed in claim 1, wherein the means for the injection of premix fuel into the at least one air inlet slot is embodied as a standard component.

18. The burner as claimed in claim 17, wherein the standard component are fastened to a burner.

19. The burner as claimed in claim 1, wherein the means for the injection of fuel into the cavity which is provided in the region of the burner axis is embodied as a jet pipe which, in addition to a central outlet nozzle for liquid fuel, has fuel outlet openings for the supply of premix fuel in a part region of the jet pipe along the burner axis remote from the end on a combustion-space side with an associated fuel supply.

20. The burner as claimed in claim 1, wherein the means for the injection of fuel into the cavity which is provided in the region of the burner axis is embodied as a conical body, the cone tip of which is aligned downstream and has an outlet nozzle for fuel.

21. A method for operating a burner including a burner axis, a cavity with at least one tangential air inlet slot, means for injection of fuel into the cavity and means for injection of premix fuel into the at least one air inlet slot including fuel outlet openings arranged on a first side and a second side of at least one fuel supply, the method comprising:

injecting fuel into the cavity in the region of the burner axis;

supplying combustion air via the at least one air inlet slot;

injecting premix fuel into the combustion air upstream of the air inlet slots relative to a direction of a combustion air flow via the fuel outlet openings arranged on the first and second side of the at least one fuel supply in a cross-sectional plane at right angles to the burner axis the premix fuel being injected where a speed of the combustion air flow is less than a speed of a combustion air flow in the air inlet slots.

22. The method as claimed in claim 21, wherein the means for the injection of fuel into the cavity which is provided in the region of the burner axis is a jet pipe, and introduces liquid fuel through a central outlet nozzle, and introduces premix fuel via a part region of the jet pipe along the burner axis remote from the end on the combustion-space side.

23. The method as claimed in claim 21, wherein a gaseous fuel is introduced into the combustion air flow via the fuel outlet openings in a cross-sectional plane at right angles to the burner axis.

24. The method as claimed in claim 21, wherein the premix fuel is introduced uniformly over the entire length of the tangential air inlet slot.

25. The method as claimed in claim 21 wherein the premix fuel is introduced separately via at least two part regions of the overall length of the tangential air inlet slot.

26. The method as claimed in claim 25, wherein a supply of the premix fuel to the fuel outlet openings of the part regions is carried out independently of one another.

27. The method as claimed in claim 26, wherein supply of the premix fuel to the fuel outlet openings of the part regions is carried out load-dependently.

28. The method as claimed in claim 21, wherein a supply of the premix fuel to individual fuel outlet openings is carried out adjustably.

* * * * *